United States Patent [19]

Friloux et al.

[11] Patent Number: 5,061,383

[45] Date of Patent: Oct. 29, 1991

[54] EMULSIFYING FILM FOAM

[76] Inventors: Edward E. Friloux, 204 Notre Dame Dr., Lafayette, La. 70506; G. Troy Mallett, P.O. Box 81518, Lafayette, La. 70598

[21] Appl. No.: 526,250

[22] Filed: May 21, 1990

[51] Int. Cl.[5] ..... A62D 1/00

[52] U.S. Cl. ..... 252/3; 252/8; 252/8.05; 169/44

[58] Field of Search ..... 252/8, 8.05, 3; 169/44

[56] References Cited

U.S. PATENT DOCUMENTS 4,049,556 9/1977 Tujimoto et al. ..... 252/3
4,663,069 5/1987 Llenado ..... 252/117
4,931,481 6/1990 Adam et al. ..... 421/123
4,963,535 10/1990 Sebag et al. ..... 514/54

*Primary Examiner*—Robert L. Stoll
*Assistant Examiner*—N. Bhat
*Attorney, Agent, or Firm*—Keaty & Keaty

[57] ABSTRACT

The invention relates to synthetic detergent compounds suitable for use as fire suppressants which contains the active ingredients of dodclybenzene sulfonic acid, cocamido propyl betaine, ethoxylated nonyl phenol, lauric acid diethanolamide, diethanolamine and propylene glycol. The fire suppressing agent forms a emulsifying film forming foam which exhibits non-hazardous properties and is biodegradable, having low drainage point with good fluidity which allows it to flow around obstructions to cover a total effected area, while maintaining its position even on vertical and curved surfaces.

11 Claims, No Drawings

EMULSIFYING FILM FOAM

BACKGROUND OF THE INVENTION

The present invention relates to fire suppressing foam compositions, and more particularly to a film forming foam for use as a fire extinguisher and in other suitable applications.

A number of fire suppressing compositions are known in the fire fighting industry. Depending on the ingredients of the compositions, they are generally divided into chemical foams and mechanical foams. The purpose of covering the fire surface by foam is to form a blanket which preferably forms a homogeneous mask of minute bubbles which ideally resist separation and rupture caused by winds, flame, etc.; which is capable of resealing itself in the event of disturbance to this established foam blanket; and which are liquid enough to flow around objects, reaching and covering areas which might ignite or which are on fire. The foam blanket ideally prevents oxygen supply to the combustion area or, in the case of a flammable liquid spill, covers the liquid preventing hazardous vapor production, as well as possible ignition of the flammable liquid. The benefits of the foam blanket can be contributed, in part, to the fact that the foam bubble has a high water content and creates a cooling effect on heated surfaces. The amount of moisture contained within the foam is usually measured by the foam drainage time—foams with a high moisture content drain at a faster rate of speed than foams with a low moisture content.

Chemical foams are generally produced by a chemical reaction of alkaline salt solution (usually sodium bicarbonate) with an acid salt solution (generally aluminum sulphate) which solution forms a carbon dioxide gas which is trapped in the bubbles of aluminum hydrate with a foaming agent (generally protein hydrolyzate). Due to the nature of the ingredients used to produce chemical foams, the two solutions, that is aluminum sulphate and sodium bicarbonate, have to be kept in separate containers and are mixed only immediately prior to their use for extinguishing a fire. The drawbacks of chemical foams are associated with toxicity of the foams, their corrosive affect on metals and continuous reaction of the ingredients. Such, the ingredient continues until all solution is consumed as a form, which may sometimes result in over applying and "boiling over" of flammable liquids. Also, if the discharge nozzle of fire extinguisher becomes clogged, the result in pressure of the continuous reaction may cause an explosion in the fire extinguishing equipment.

Mechanical forms are produced by aeration of a foam solution to cause entrapment of air within the foam bubbles.

The mechanical foams used are protein foams, fluoroprotein foams, synthetic detergent foams, and aqueous film forming foams (afff).

Protein foam is usually manufactured by alkaline or acid hydrolyses of either vegetable or animal proteins which form a hydrolyzed protein solution. Iron salts are added to provide heat resistance and mechanical stability to the foam bubbles. The protein type mechanical foams are most effective on flammable liquid fires involving hydrocarbon fuels when the temperature of the liquid exposed to the fire does not exceed 250 degrees fahrenheit or when the liquid is in storage tanks. The draw backs associated with protein mechanical foams comprise, entirely, incompatibility of the foam with dry powder fire extinguishing agent, its limited effectiveness in comparison with other types of foams when applied with foam monitors to flammable liquids with low flash points such as gasoline, polar solvents and alcohol, as well as limited ability to achieve total surface covering in difficult to reach places. Fluoroprotein foams were found to be effective for some surface application to tank fires due to their increased resistance to hydrocarbon fuel saturation, their ability to secure the fuel surface against flash back and their superior resistance to radiant heat and over-head water application. To produce fluoroprotein mechanical foam, regular protein based foam liquids and certain fluorinated surfactants are combined.

Synthetic detergent or waiting agent types of mechanical foams are characterized by their significant expansion rate (approx. 20 to 1 as compared to 8 to 1 or 10 to 1 expansion ratios for protein or fluoroprotein foams). The synthetic detergent foam has good fluidity but low stability and rapid drainage time, as well as little radiant heat resistance and rapid dissipation. Synthetic detergent foam liquids comprise surfactants, foam stabilizers and freezing point depressants. The synthetic detergent foams (high expansion synthetic detergent foams) provide an insulating shield from the heat and allows fire fighters to breath and function in the foam mask, if necessary.

Aqueous film forming foam uses fluorocarbon surfactants and various foam stabilizers. It can be used with fresh water or salt water, resists brake down by dry chemical agents. The aqueous film forming foam has low viscosity and surface tension which allows it to spread over the fuel surface rapidly and extinguish shallow or deep fuel spill fires. The major draw back of this type of foam is that it has a rapid drainage time over which may cause the flammable liquid to be exposed to potential ignition, once the foam has drained away.

The present invention contemplates elimination of the drawbacks associated with prior art by providing a mechanical foam which is effective on hydrocarbon fuels, alcohol and polar solvent and flammable liquids.

SUMMARY OF THE INVENTION

It is therefore an object of the present invention to provide a fire suppressing agent which would form an emulsifying film forming foam in fires involving hydrocarbon fuels, alcohol, low flash point and solvent flammable liquids.

It is a further object of the present invention to provide a non-toxic, non-corrosive, non-flammable, non-hazardous, biodegradable fire suppressing agent.

It is still a further object of the present invention to provide a composition of matter suitable for use of fire suppressing agent in 1%-6% concentrations in water base.

These and other objects of the present invention are achieved by providing a composition of matter which comprises dodecylbenzene sulfonic acid, cocamido propyl betaine, ethoxylated nonyl phenol, lauric acid diethanolamide, diethanolamine and propylene glycol mixed in water base. In one of its embodiments the composition of matter provides for a mixture in water of between about 0.17% and 1.36% by total weight of ethoxylated nonyl phenol, between about 1.3 and 10.4% by total weight of cocamido propyl betaine mixed with dodeclybenzene sulfonic acid in an amount between about 2 and 2.5 times the concentration of ethoxylated nonyl phenol, lauric acid diethanolamide in amount between about 1.5 and 2 times the concentration of the dodeclybenzene sulfonic acid, and diethanolamine and propylene glycol in equal amounts of between about 2 and 2.5 times the concentration of lauric acid diethanolamide. In its preferred embodiment, the composition of matter provides for the use of 3% by total weight of dodeclybenzene sulfonic acid, 2.6% by total weight of cocamido propyl betaine, 0.3% by total weight of ethoxylated nonyl phenol, 5.66% by total weight of lauric acid diethanolamide and equal amounts of 2.46% by total weight of diethanolamine and propylene glycol all mixed in water base.

DETAILED DESCRIPTION OF THE PREFERRED EMBODIMENT

The composition of matter in accordance with the present invention comprises between about 1.5–12% of dodecylbenzene sulfonic acid, between about 1.3–10.4% by weight of cocamido propyl betaine, between about 0.17–2.36% by weight of ethoxylated nonyl phenol, between about 2.83–22.6% by weight of lauric acid diethanolamide, between about 1.23–9.84% by weight of diethanolamine and between 1.23–9.84% by weight of propylene glycol in aqueous solution. The emulsifying film foam of the present invention is a synthetic detergent compound which uses dodecylbenzene as a detergent agent and diethanolamide as a emulsifier. The composition concentrate of the present invention exhibits all of the positive qualities of the protein, fluoroprotein, synthetic detergent and aqueous film forming foams, while eliminating the negative attributes of these foams. It was found that 3–6% concentrations of the composition of matter of the instant application are affective as fire suppressants, although effectiveness is not lost in far less concentrated solutions. The present composition was found to be especially effective on hydrocarbon fuels, whether deep storage or shallow spills, alcohol and solvent flammable liquids.

Depending upon the method of application, the emulsifying film foam has an expansion ratio of 20:1 to 30:1, if used with standard nozzles and 100:1, when using high expansion generators. The emulsifying film foam has better than average fluidity, which allows the foam to flow around obstructions and achieve total surface coverage even on vertical and curved surfaces. The composition of the present invention having high moisture content still exhibits stable characteristics and has a slow drainage time which prevents its dissipation due to winds and other adverse environmental conditions, allowing long lasting coverage of the fire affected area. The test showed that the foam blanket produced with the emulsifying foam of the present invention lasts for well over an hour and exhibits resistance to radiant heat and "burn back", as well as low flash point solvent deterioration. The foam blanket restricts flammable vapors from escaping from the flammable liquids and affords protection to fire fighters.

The emulsifying film foam of the present invention is non-toxic, non-corrosive, non-flammable, non-hazardous, practically biodegradable and, since it uses no halons, causes no ozone layer depletion. The composition of the present invention exhibits the following physical properties:

| Properties | Data |
|---|---|
| Color | Clear colorless liquid |

-continued

| Properties | Data |
|---|---|
| Odor | Mild surfactant order |
| Density | 8.34 per gallon |
| ph | 9.0–8.5 |
| Specific gravity | About 1.00 |
| Boiling point | 160 degrees |

The emulsifying film foam of the present invention was listed as an oil dispersant by the U.S. Environmental Protection Agency on the National Contingency Plan for oil spills and incidents under the trade name "Omni Clean Multi Foam".

Following our examples of the compound in accordance with the present invention which are useful in producing a particular type of synthetic detergent compound.

EXAMPLE 1

25 07% by weight of water was placed in a vat.

In a separate vat by 1.5 percent by weight of the dodeclybenzene sulfonic acid was premixed with 0.17% by weight of ethoxylated nonyl phenol. After thorough blending of the materials in the second vat, the premixed materials were added to the first vat containing water. With continuing stirring 1 3% by weight of cocamido propyl betaine was added, then 2.83% by weight of lauric acid diethanolamide, then 1.23% by weight of diethanolamine and then 1.23% by weight of propylene glycol were added. The balance of 66.67% by weight of water was added to the mixture, which was continued to be stirred for an additional 15 minutes.

EXAMPLE 2

25.07% by weight of water was deposited in a vat in a separate vat 3% by weight of dodeclybenzene sulfonic acid was mixed with 0.34% of ethoxylated nonyl phenol. The resulting mixture was thoroughly blended and then deposited in the first vat containing water.

To the first vat the following ingredients were added while continuously stirring: 2.6% by weight of cocamido propyl betaine 5.66% by weight of lauric acid diethanolamide, 2.46% by weight of diethanolamine and 2.46% of propylene glycol. Then 58.41% by weight of water was added and the mixture was stirred for an additional 15 minutes.

EXAMPLE 3

25.07% of water was deposited in a vat. In a separate vat 12% by weight was premixed with 1.36% by weight of ethoxylated nonyl phenol. The mixture was thoroughly blended and then deposited into the first vat containing water. While continuously stirring the following ingredients were added to the first vat: 10.4% by weight of cocamido propyl betaine, 22 64% of lauric acid diethanolamide, 9.84% by weight of diethanolamine and 9.84% by weight of propylene glycol. Finally, 8.85% by weight of water was added to the mixture which was stirred for an additional 15 minutes.

The result of the emulsifying film foam has specific gravity of about 0.97–1.09, depending on the amount of active ingredients in the aqueous solution.

It exhibits other physical properties aforementioned.

While a number of examples were described herein, it is to be understood that many changes can be made in the present invention with those skilled in the art without departing from the spirit thereof. I therefore pray that my rights to the present invention are limited only by the scope of the appended claims.

I claim:

1. A composition of matter suitable for use as a fire suppressant, comprising:

A mixture of between about 1.5% and 12% by total weight of the dodecylbenzene sulfonic acid, between about 1.3% and 10.4% by total weight of cocamido propyl betaine, between about 0.17% and 1.36% by total weight of ethoxylated nonyl phenol, between about 2.83% and 22.64% by total weight of lauric acid diethanolamide, between about 1.23% and 9.84% by total weight of diethanolamine and between about 1.23% and 9 84% by total weight of propylene glycol in water.

2. A composition of matter suitable as a fire suppressant, comprising:

A mixture in water of between about 0.17% and 1.36% by total weight of ethoxylated nonyl phenol; between about 1.3% and 10.4% of cocamido propylene betaine; dodecylbenzene sulfonic acid in an amount between about 2 and 2.5 times the concentration of ethoxylated nonyl phenol; lauric acid diethanolamide in an amount between about 1.5 and 2 times the concentration of dodecylbenzene sulfonic acid; and diethanolamine and propylene glycol in equal amount of between about 2 and 2.5 times the concentration of lauric acid diethanolamide.

3. A fire suppressing agent, comprising:

dodecylbenzene sulfonic acid;
Cocamido propyl diethanolamine;
ethoxylated nonyl phenol;
lauric acid diethanolamide; and
propylene glycol
mixed in an aqueous base.

4. The fire suppressant agent of claim 3, wherein the composition contains at least 1.5% by total weight of dodecylbenzene sulfonic acid.

5. The fire suppressant agent of claim 3, wherein the composition contained at least 2.83% by total weight of lauric acid diethanolamide.

6. The fire suppressant agent of claim 3, wherein the composition contains at least 1.3% by total weight of cocamido propyl betaine.

7. The fire suppressant agent of claim 3, wherein the composition contains at least 1.23% by total weight of diethanolamine and an equal amount of propylene glycol.

8. The fire suppressant agent of claim 3, wherein the composition contains at least 0.17% by total weight of ethoxylated nonyl phenol.

9. A fire suppressing agent, comprising:

an aqueous solution of dodecylbenzene sulfonic acid, from 1.5% to 12% by total weight;
an aqueous solution of cocamido propylene betaine, from 1.3% to 10.4% by total weight;
0.17% to about 1.36% of total weight of ethoxylated nonyl phenol;
lauric acid diethanolamide, from 2.83% to 22.64% by total weight;
diethanolamine in propylene glycol in equal amounts from 1.23% to 9.84% by total weight;
mixed in an aqueous base.

10. A method of suppressing fire, which comprises the step of covering an effected surface with a fire suppressing agent comprising;

from 1.5% to 12% by total weight of dodecylbenzene sulfonic acid;
from 1.3% to 10.4% by total weight of cocamido propyl betaine;
from 0.17% to 1.36% of total weight of ethoxylated nonyl phenol;
from 2.3% to 22.64% by total weight of lauric acid diethanolamide;
equal amounts of between about 1.23% and 9.84% by total weight of diethanolamine and propylene glycol, all active ingredients being mixed in water to form an emulsifying film foam of between 2% and 6% concentration.

11. A composition for use as an effective fire suppressing agent which comprises from 1.5% to 12% by total weight of the dodecylbenzene sulfonic acid, from 1.3% to 10.4% by total weight of cocamido propylene betaine, from 0.17% to 1.36% by total weight of the ethoxylated nonyl phenyl, from 2.83% to 22.64% by total weight of lauric acid diethanolamide, equal amounts of between about 1.23% and 9.84% by total weight of diethanolamine and propylene glycol mixed in water to form between 2% and 6% concentrate.

* * * * *